US009682405B2

(12) United States Patent
Snyder et al.

(10) Patent No.: US 9,682,405 B2
(45) Date of Patent: Jun. 20, 2017

(54) SYSTEMS AND METHODS FOR THE ENVIRONMENTAL REMEDIATION OF MATERIALS CONTAMINATED WITH HEAVY MINERALS

(71) Applicants: Michael J. Snyder, Twentynine Palms, CA (US); Jackie R. See, Fullerton, CA (US)

(72) Inventors: Michael J. Snyder, Twentynine Palms, CA (US); Jackie R. See, Fullerton, CA (US)

(73) Assignee: Vortex Technology, LLC, Reno, NV (US)

( * ) Notice: Subject to any disclaimer, the term of this patent is extended or adjusted under 35 U.S.C. 154(b) by 0 days.

(21) Appl. No.: 14/833,119

(22) Filed: Aug. 23, 2015

(65) Prior Publication Data

US 2016/0067744 A1 Mar. 10, 2016

Related U.S. Application Data

(60) Provisional application No. 62/041,068, filed on Aug. 23, 2014.

(51) Int. Cl.

| | |
|---|---|
| ***B03B 7/00*** | (2006.01) |
| ***B07B 4/08*** | (2006.01) |
| ***B03B 4/02*** | (2006.01) |
| ***B07B 7/086*** | (2006.01) |
| *B07B 1/10* | (2006.01) |
| *B03B 4/04* | (2006.01) |

(52) U.S. Cl.

CPC ..... *B07B 4/08* (2013.01); *B03B 4/02* (2013.01); *B07B 7/086* (2013.01); *B03B 4/04* (2013.01); *B07B 1/10* (2013.01)

(58) Field of Classification Search

CPC .. B07B 7/00; B07B 7/04; B07B 7/086; B07B 1/10; B07B 4/08; B03B 4/02; B03B 4/04

USPC ..... 209/470, 471, 472, 485, 486

See application file for complete search history.

(56) References Cited

U.S. PATENT DOCUMENTS

| | | | | |
|---|---|---|---|---|
| 3,710,558 A * | 1/1973 | Feder | B04C 3/00 209/30 |
| 3,773,174 A * | 11/1973 | Stimpel | B03C 7/04 209/131 |
| 4,326,635 A | 4/1982 | Collins | |
| 4,451,357 A * | 5/1984 | LaVigne | B03C 7/08 209/131 |
| 5,141,651 A | 8/1992 | Giddings | |
| 5,165,549 A * | 11/1992 | Kanda | B07B 7/086 209/135 |

(Continued)

*Primary Examiner* — Joseph C Rodriguez
*Assistant Examiner* — Kalyanavenkateshware Kumar
(74) *Attorney, Agent, or Firm* — Law Office of Timothy M. Brown

(57) ABSTRACT

The invention relates to a method and system for the environmental remediation of materials that are contaminated with heavy minerals, such as heavy metals. The invention finds utility in removing heavy minerals from materials such as soils, sediments, mine tailings and ores. The invention provides a means for removing heavy minerals from contaminated materials without the use of water while reducing the generation of dust. Thus, the invention provides an environmentally friendly method for the remediation of sites that are contaminated with heavy minerals.

16 Claims, 5 Drawing Sheets

(56) References Cited

U.S. PATENT DOCUMENTS

| | | | |
|---|---|---|---|
| 5,375,721 | A | 12/1994 | LaVigne |
| 7,119,298 | B2 | 10/2006 | Yoshiyama et al. |

* cited by examiner

SYSTEMS AND METHODS FOR THE ENVIRONMENTAL REMEDIATION OF MATERIALS CONTAMINATED WITH HEAVY MINERALS

CROSS-REFERENCE TO RELATED APPLICATIONS

This application claims priority to provisional application Ser. No. 62/041,068 filed Aug. 23, 2014, the entire contents of which are incorporated herein by reference in their entirety for all purposes.

BACKGROUND

1. Field of the Invention

The invention generally relates to systems and methods for the environmental remediation of materials contaminated with heavy minerals. More particularly, the invention relates to systems and methods for removing heavy minerals from materials such as soil, mine tailings, sediments and ores without the use of water or the creation of dust.

2. Description of the Related Art

Some heavy minerals can pose an environmental threat due to their toxicity to living systems. Unlike organic pollutants, toxic heavy minerals once introduced into the environment cannot be biodegraded. They persist indefinitely and cause pollution of air, water, and soils. Thus, the main strategies of pollution control are to reduce the bioavailability, mobility, and toxicity of the minerals. Methods for remediation of toxic heavy mineral-contaminated environments include physical removal, detoxification, bioleaching, and phytoremediation. Lead, mercury, cadmium lithium, manganese, thallium, tin, nickel, chromium, aluminum, and zinc are but a few examples of heavy minerals that can have toxic effects in their elemental form, or through the formation of toxic compounds. Metal toxicity or metal poisoning is the toxic effect that certain metals have on living organisms. In the case of lead, any measurable amount may have negative health effects.

Industrial manufacturing, smelting, mining activities, sedimentation and runoff are common sources of heavy mineral contamination. The predominance of these sources of contamination create a widespread need for devices and methods that are capable or addressing these environmental problems. Heavy mineral contamination poses risks for both municipal and wildlife concerns. For example, heavy minerals pose a risk to aquatic wildlife as well as municipal sources of drinking water such as reservoirs and ground water.

The toxic effects of heavy minerals in aquatic environments (e.g. streams, creeks, lakes and rivers) is surprisingly similar to that outside a water body. Sediments in aquatic environments exhibit the same binding characteristics found in the normal soil environment. As a result, many heavy minerals tend to be sequestered at the bottom of water bodies. Some of these minerals will dissolve. The aquatic environment is more susceptible to the harmful effects of heavy mineral pollution because aquatic organisms are in close and prolonged contact with the soluble minerals.

Soils may become contaminated by the accumulation of heavy metals and metalloids through emissions from rapidly expanding industrial areas, mine tailings, disposal of high metal wastes, leaded gasoline and paints, land application of fertilizers, animal manures, sewage sludge, pesticides, wastewater irrigation, coal combustion residues, spillage of petrochemicals, and atmospheric deposition. Toxic heavy metals constitute an ill-defined group of inorganic chemical hazards, and those most commonly found at contaminated sites are lead (Pb), chromium (Cr), arsenic (As), zinc (Zn), cadmium (Cd), copper (Cu), mercury (Hg), and nickel (Ni). Soils are the major sink for heavy metals released into the environment by the aforementioned anthropogenic activities, and unlike organic contaminants which are oxidized to carbon (IV) oxide by microbial action, most metals do not undergo microbial or chemical degradation and their total concentration in soils persists for a long time after their introduction. Changes in their chemical forms (speciation) and bioavailability are, however, possible. The presence of toxic heavy metals in soil can severely inhibit the biodegradation of organic contaminants. Heavy metal contamination of soil may pose risks and hazards to humans and the ecosystem through: direct ingestion or contact with contaminated soil; the food chain (soil-plant-human or soil-plant-animal-human); drinking of contaminated ground water; reduction in food quality (safety and marketability) via phytotoxicity; reduction in land usability for agricultural production causing food insecurity; and land tenure problems.

There are several methods for the remediation of environmental contamination due to toxic heavy minerals. These methods include excavation of soils wherein a contaminated material, such as soil, is collected and taken to a disposal site. This method of remediation however potentially requires the transport of large volumes of material only a small portion of which comprises the heavy mineral. Thus, large volumes of material are extracted in an effort to remove a small amount of heavy mineral. In addition, the material removed must oftentimes be replaced. Aeration is another method of removing heavy minerals (e.g. heavy metals) from a contaminated area, but this method creates air pollution and further disperses the contaminated heavy minerals.

Leaching and sluice boxes also provide a means for removing heavy minerals from contaminated materials. These methods however require the use of large volumes of water which may not be available near sites where environmental remediation is desired. In fact, locations where environmental remediation of heavy minerals is desired is often remote and far removed from any practical source of water. Moreover, even in locations where a source of water is available, the scarcity of water and the competing needs of municipal, agricultural and wildlife uses makes the use of water for environmental remediation impractical.

What is needed in the art therefore are water-free, dust-free systems and methods for the removal of heavy minerals from contaminated materials such as soils, sediments and ores.

SUMMARY OF THE INVENTION

An objective of the invention is to provide a method for the environmental remediation of a material that is contaminated with a heavy mineral, the method comprising providing a material that is contaminated with or suspected of containing at least one heavy mineral, subjecting the contaminated material to a vortex particle separator under conditions sufficient to remove a first portion of dust particles from the contaminated material thereby producing a dust suppressed contaminated material, loading the dust suppressed contaminated material onto an elongated porous belt assembly that comprises a plurality of cross members, wherein the belt assembly rotates upward with respect to an incline, forcing air or other gas through the belt assembly as the belt assembly rotates upward with respect to the incline, wherein the forcing of the gas through the belt assembly fluidizes the dust suppressed contaminated material in a manner that causes at least a first portion of the at least one heavy mineral to gather on the plurality of cross members while the remainder of the dust suppressed contaminated material flows down the incline and off of the belt assembly as the belt assembly rotates upward with respect to the incline, and collecting the gathered at least one heavy mineral.

In some aspects, the method comprises collecting a second portion of dust particles from the dust suppressed contaminated material as the dust suppressed contaminated material is fluidized by the forcing of air or other gas through the belt assembly.

In some aspects, the belt assembly is contained within an enclosure that is configured to collect dust particles that become airborne as the gas is forced through the belt assembly.

In some aspects, the method comprises collecting the airborne dust particles under vacuum filtration.

In some aspects, the contaminated material is selected from mine tailings, soil, ore and sediment.

In some aspects, the at least one heavy mineral is a toxic heavy mineral.

In some aspects, the at least one heavy mineral is a radioactive heavy mineral.

In some aspects, the belt assembly comprises at least one oscillation device that is configured to provide vibration to the belt assembly.

In some aspects, the method comprises collecting a second portion of the at least one heavy mineral from the remainder of the dust suppressed feed material.

In some aspects, the remainder of the contaminated material is substantially free of the at least one heavy mineral.

A further objective of the invention is to provide a system for the environmental remediation of a material that is contaminated with a heavy mineral, wherein the system comprises a vortex particle separator that is configured to remove dust particles from a material that is contaminated with at least one heavy mineral, a porous belt assembly that is configured to receive from the vortex particle separator the material that is contaminated with at least one heavy mineral, an air box in gaseous communication with the porous belt assembly, wherein the porous belt assembly surrounds the air box and the gaseous communication forces air or other gas through the porous belt assembly and the contaminated material, and a motor for driving the porous belt assembly in a manner that causes the porous belt assembly to rotate about the air box at an incline with respect to a horizontal axis.

In some aspects, the system comprises an enclosure that substantially encloses the porous belt assembly and the air box in a manner that prevents dust particles from escaping the enclosure when dust particles are made airborne as a result of air being forced from the air box through the porous belt assembly and the contaminated material.

In some aspects, the system comprises a vacuum motor for producing a vacuum within the enclosure, and a particle collection assembly in communication with the enclosure and the vacuum motor, wherein the particle collection assembly is configured to collect the airborne dust particles.

In some aspects, the system comprises at least one oscillation motor connected to the porous belt assembly in a manner that permits the at least one oscillation motor to produce vibration in the porous belt assembly.

DEFINITIONS

Figure 1:
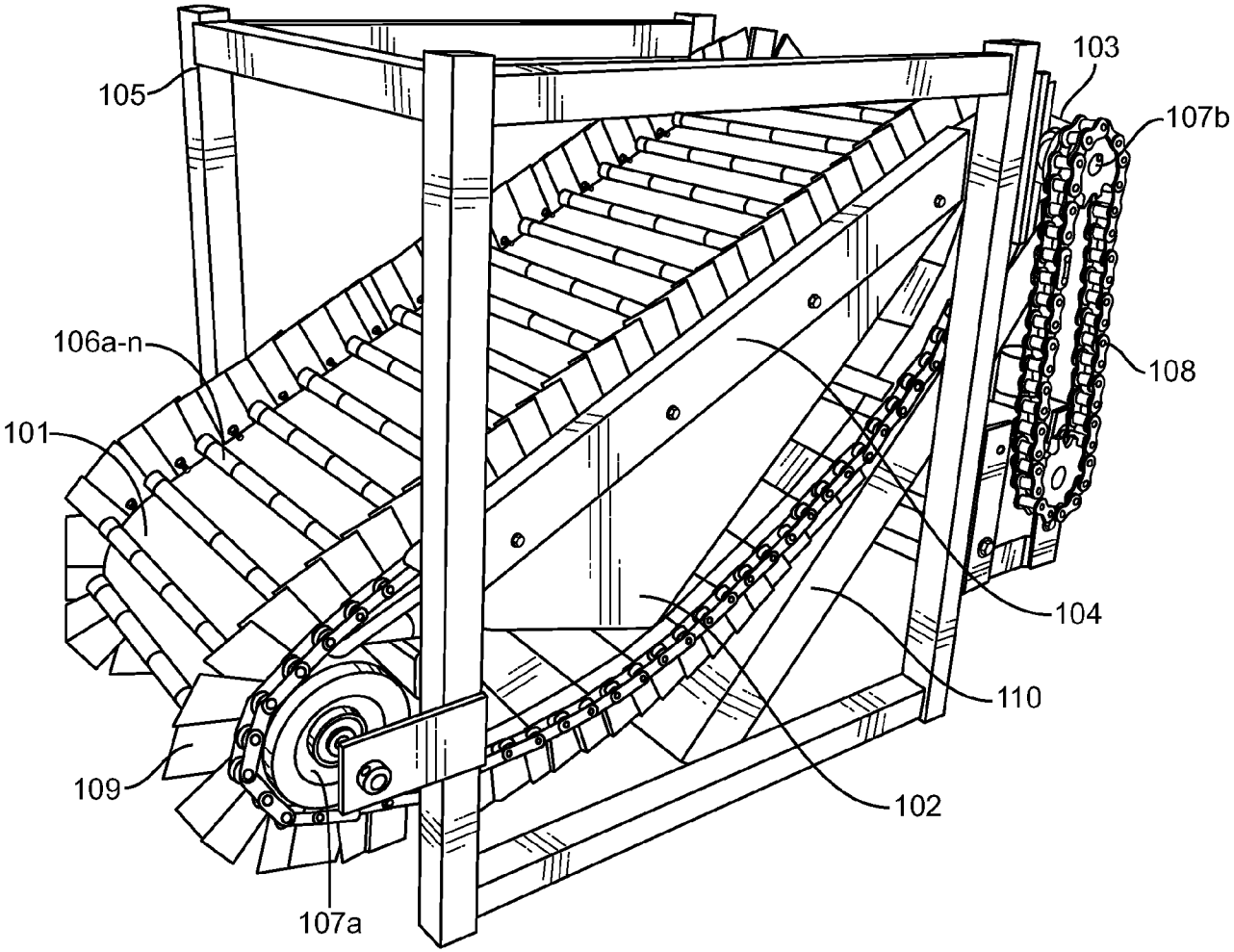
FIG. 1 shows a perspective view of an embodiment of a system according to the invention.

The term "heavy mineral" as used herein refers to one or more of gold, silver, platinum, palladium, rhodium, iridium, osmium, ruthenium, zirconium, hafnium, lanthanum, cerium, praseodymium, neodymium, samarium, europium, gadolinium, terbium, holmium, erbium, thulium, ytterbium, lutetium, dysprosium, scandium, yttrium, aluminum, arsenic, antimony, barium, beryllium, bismuth, calcium, cadmium, cobalt, chromium, cesium, copper, iron, gallium, germanium, hafnium, indium, potassium, lithium, magnesium, manganese, mercury, molybdenum, sodium, niobium, nickle, phosphorus, lead, rubidium, rhenium, sulfur, selenium, strontium, tin, thorium, tantalum, tellurium, titanium, thallium, uranium, vanadium, tungsten, zinc and any heavy minerals of silicates, oxides, sulfates, sulfides, carbonates or halides. The term "heavy mineral" also includes, but is not limited to, heavy metals.

The term "heavy metal" as used herein refers to toxic metals, including, but not limited to, lead, chromium, arsenic, zinc, aluminum, cadmium, copper, mercury, and nickel.

The term "fluidization" as used herein, and derivatives of the term, refers to a process whereby a granular material is converted from a static solid-like state to a dynamic fluid-like state. This process occurs when a fluid (liquid, air or other gas) is passed through the granular material, such as, for example a contaminated material.

The phrase "environmental remediation" as used herein refers to the removal of at least a portion of at least one heavy mineral from a contaminated material.

The phrase "contaminated material" as used herein includes, but is not limited to, materials that contain, or are suspected of containing, at least one heavy mineral. Some non-limiting examples of contaminated materials include, but are not limited to, mine tailings, soil, smelter waste, mine waste, placer material, ore, topsoil, coal, crushed rock, sediments and combinations thereof.

The term "feed material" as used herein refers to a contaminated material that is introduced into one or more of the devices and/or systems disclosed in the present specification. Feed materials include, but are not limited to, processed feed materials and dust-suppressed feed materials.

The phrase "processed feed material" as used herein refers to a feed material that has been subjected to the methods and/or systems disclosed herein to remove at least a portion of at least one heavy mineral from the feed material. That is, a processed feed material is a feed material that has had at least a portion of heavy minerals removed from it using one or more of the systems and/or methods disclosed herein.

The phrase "dust-suppressed feed material," or "dust suppressed material," refers to a contaminated material that has at least a portion of dust particles removed from the contaminated material.

The phrase "purified material," or "enriched material," refers to heavy minerals that have been collected, purified or otherwise enriched from a feed material, such as by processing according to one or more of the systems and/or methods disclosed herein.

The term "sediment" as used herein refers to matter that settles to the bottom of a liquid. The term sediment includes, but is not limited to, any matter (e.g. silt or soil) that settles to the bottom of lakes, ponds, reservoirs, basins, bays, rivers, creeks, estuaries, bogs, beaches and shores, for example. Sediments may contain, or be suspected of containing, at least one heavy mineral.

The term "about" as used herein refers to a quantity, level, value, number, frequency, percentage, dimension, size, amount, weight or length that varies by as much as 30, 25, 20, 25, 10, 9, 8, 7, 6, 5, 4, 3, 2 or 1% to a reference quantity, level, value, number, frequency, percentage, dimension, size, amount, weight or length. In particular embodiments, the terms "about" or "approximately" when preceding a numerical value indicates the value plus or minus a range of 15%, 10%, 5%, or 1%, or any intervening range thereof.

DETAILED DESCRIPTION

The invention provides systems and methods for the environmental remediation of materials that are contaminated with at least one heavy mineral. More particularly, the invention provides systems and methods for removing heavy minerals from materials from that are contaminated with or suspected of containing at least one heavy mineral wherein the removal is accomplished without the use of water and with the reduced generation of dust.

In some embodiments, the invention finds use in the remediation of environmental hazards that are the result of mining activity. For example, the systems and methods described herein may be used to remove at least a portion of at least one heavy mineral from materials such as mine waste, coal, crushed rock, mine tailings, ores (e.g. head ore) and smelter waste.

In some aspects, the invention provides an environmentally safe way to remove heavy minerals from contaminated materials without the use of water or the creation of substantial airborne particulate pollution. This is particularly advantageous because many sites that contain heavy minerals are located in regions that lack a sufficient source of water. Thus, these sites are incapable of environmental remediation through applications that require the use of water, such as leaching and phytoremediation. In addition, the systems and methods of the invention avoid the creation of significant airborne pollution that could otherwise spread toxic heavy mineral contaminants and create a respiratory hazard and potentially contaminate a wider range of area than the original contamination site. In addition, dust particles themselves can create a respiratory hazard regardless of containing toxic heavy metal constituents. Thus, the system and methods disclosed herein may be used in close proximity to populated areas without posing an environmental hazard.

Turning to the figures, FIG. 1 shows a system in accordance with the invention wherein porous belt assembly 101 surrounds air box 102. Porous belt assembly 101 is in mechanical communication with drive motor 103 which is configured to drive porous belt assembly 101 around air box 102. Air box 102 comprises upper edge 104 which is in contact with the bottom portion of porous belt assembly 101. In a preferred embodiment, air box 102 contacts porous belt assembly in a manner that prevents the escape of at least a majority of air pressure generated by the system so that positive pressure can be formed within air box 102 so that air or another gas is forced through porous belt assembly 101. Though not depicted in FIG. 1, the system may comprise one or more oscillator motors for creating vibration throughout the system, and porous belt assembly 101 in particular. The oscillator motors may, for example, be connected to any edge of air box 102, (including the upper edge 104), frame 105 and/or drive motor 103. In a preferred embodiment, the one or more oscillator motors are connected to the system in a manner that creates vibration on the porous belt assembly 101 so as to provide enhanced fluidization of the contaminated material. In some aspects, the system of the invention incorporates particle separator 200.

Air box 102 is manufactured from a material that is sufficiently strong and reinforced to support the weight of a contaminated feed material that is fed onto porous belt assembly 101. Air box 102 comprises a cavity and opening for placing the cavity in fluid communication with porous belt assembly 101. The opening is preferably in the shape of porous belt assembly 101 so as to allow air to pass from the cavity through the entire width of porous belt assembly 101. Air box 102 further comprises an air box inlet for receiving compressed air or other gas from a source such as a blower, compressor, fan or source of compressed air or other gas, for example. In aspects of the invention, the compressed air or other gas is provided at a CFM of about 1,500 to 0 at standard pressure.

Referring to FIG. 1, porous belt assembly 101 is configured in a loop design to permit the porous belt assembly to surround air box 102 and a pair of opposing sprockets 107*a-b* and their shafts (not shown). Sprocket 107*b* is in mechanical communication with drive motor 103 through drive chain 108. The body of porous belt assembly 101 comprises a material that permits air to flow through it from air box 102, while having a porosity that is sufficiently small to collect particles of heavy minerals ranging from about 4 mesh to about 200 mesh. The edges of porous belt assembly 101 comprise a segmented feed material barrier 109 which is connected to porous belt assembly 101. Traversing porous belt assembly 101 are a plurality of cross members 106*a-n*. Cross members 106*a-n* may assume a variety of configurations, including rod-shapes, or any other shape that permits heavy mineral particles to collect at the upward juncture of porous belt assembly 101 and cross-members 106*a-n*. Cross-members 106*a-n* contact porous belt assembly 101 along their length such that particles of heavy minerals are permitted to collect at the juncture of porous belt assembly 101 and cross-members 106*a-n*. Cross members 106*a-n* may be fixed to porous belt assembly 101, such as by adhesive, or they may be held against porous belt assembly 101 by tension created through the compression of cross members 106*a-n* against porous belt assembly 101.

In an aspect of the invention, porous belt assembly 101 can comprise three layers of materials, with the top layer (which is exposed to contaminated feed material) being made of canvas or woven cotton fabric (e.g. finely woven at 200 thread count or higher). The middle layer of porous belt assembly 101 can be a reticulated polyester foam which is air pervious, while the bottom layer of porous belt assembly 101 consists of a polyester flannel material coated with polyethylene film, having openings of about 2 mm to about 2,000 microns in size. The outer edges of the belt may be sewn together on both sides with standard upholstery trim edging material.

Figure 2:
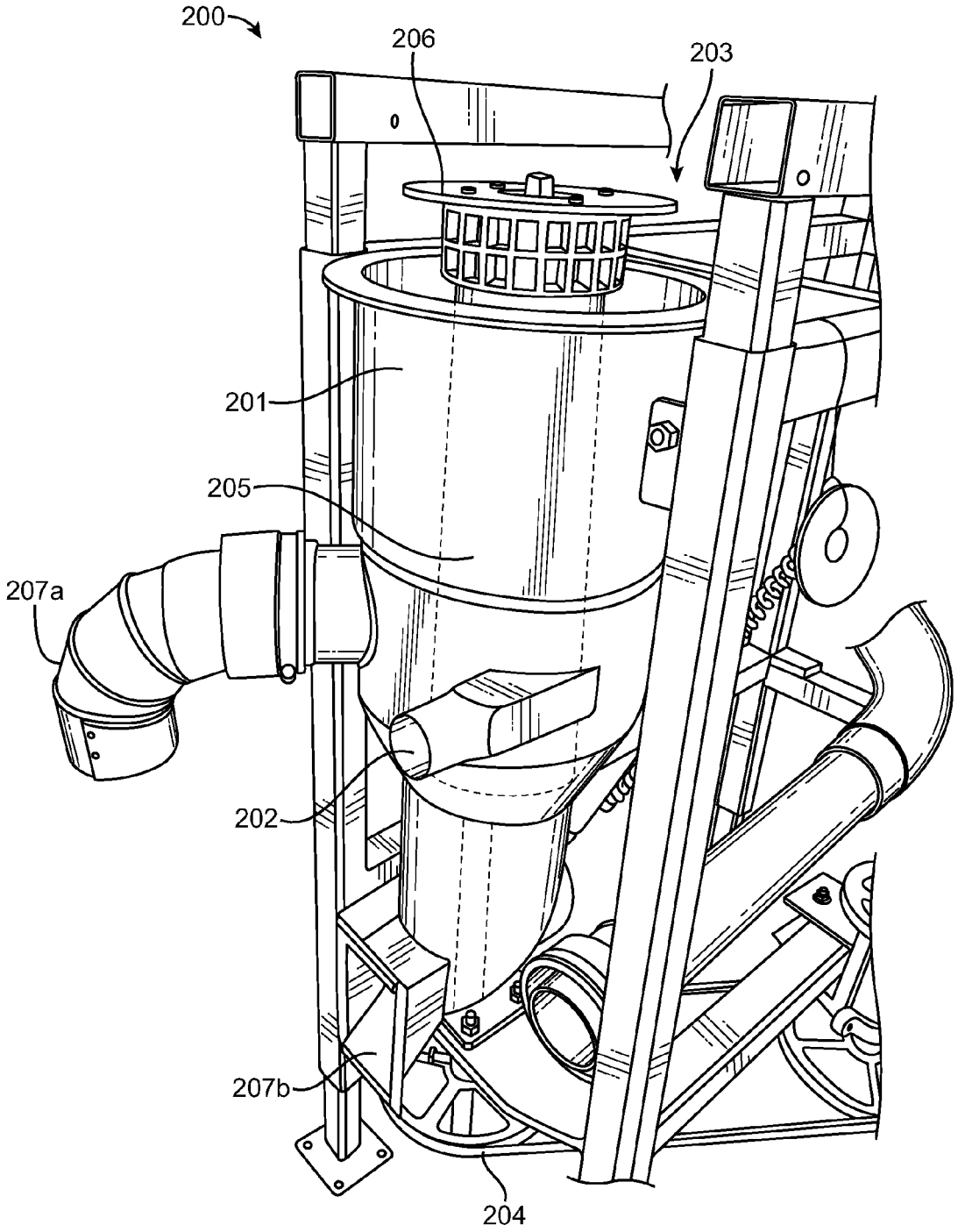
FIG. 2 shows a perspective view of an embodiment of a particle separator according to the invention.

FIG. 2 depicts a particle separator comprising casing 201 having air inlet 202 and feed inlet 203. Particle separator motor 204 is mechanically connected to cam body 205 so as to drive the rotation of cam body 205 within casing 201. In practice, the particle separator functions by air being forced into casing 201 through air inlet 202 as a contaminated material is fed into casing 201 through feed inlet 203. Cam body 205 rotates as feed material is fed into casing 201 through feed inlet 203 where the feed material contacts deflector plate 206. Though not shown, feed inlet 203 can comprise a cap (e.g. conically or dome shaped cape) having an aperture and/or tube for receiving a feed material. The cap forms a seal with casing 201 to permit the buildup of pressure within casing 201. The rotation of deflector plate 206 projects feed material against the inner walls of casing 201 as air is simultaneously forced into casing 201 through air inlet 202 and into cam body 205 where the forced air exits casing 201 through an air outlet (not shown) which is located at the bottom of casing 201. The flow of air through casing 201 and the hollow interior of cam body 205 causes lighter, dust creating particles to separate from the heavier portion of the feed material as the feed material is cast off deflector plate 206 and against casing 201 such that at least a portion of dust particles separate from the feed material as they are caught up in the flow of air where they flow through the hollow interior of cam body 205 and exit through the bottom of casing 201 through the air outlet. The air outlet may be attached to a vacuum source and dust collection apparatus, such as a filter, to provide a dust suppressed contaminated material. By removing dust particles in the manner described, the system and method of the invention produces a dust-suppressed feed material which flows down casing 201 where it may be collected from feed exit ports 207*a* and 207*b*. The size and density of dust particles that are removed from contaminated material may be adjusted by varying the velocity of air that is forced into the particle separator, as well as by adjusting the vacuum pressure that may be used to collect dust particles through the air outlet. The dust-suppressed feed material may be re-introduced to the particle separator one or more times to further reduce the presence of dust particles in the dust-suppressed feed material.

Aspects of the invention relate to the removal of heavy minerals from contaminated materials without the use of water or generation of substantial airborne dust particles. This may be accomplished, for example, by subjecting the contaminated material to particle separator 200 before the contaminated material is subjected to environmental remediation by the systems of the invention. Contaminated material so subjected to particle separator 200 has at least a portion of dust particles removed from the contaminated material thereby producing a dust-suppressed contaminated material. Particle separator 200 may form an integral portion of the systems of the invention such that particle separator 200 is permitted to feed contaminated material onto porous belt assembly 101 such as by augers and/or a convey belt configuration. The removal of dust offers another advantage to the methods of the invention because removal of dust prevents feed material from fouling the pores of the porous components of the systems invention thereby providing enhanced fluidization of feed material due to increased permeation of air or other gas through the porous components. This, in turn, provides for the improved collection (i.e. enrichment) of heavy minerals from contaminated materials.

Figure 3:
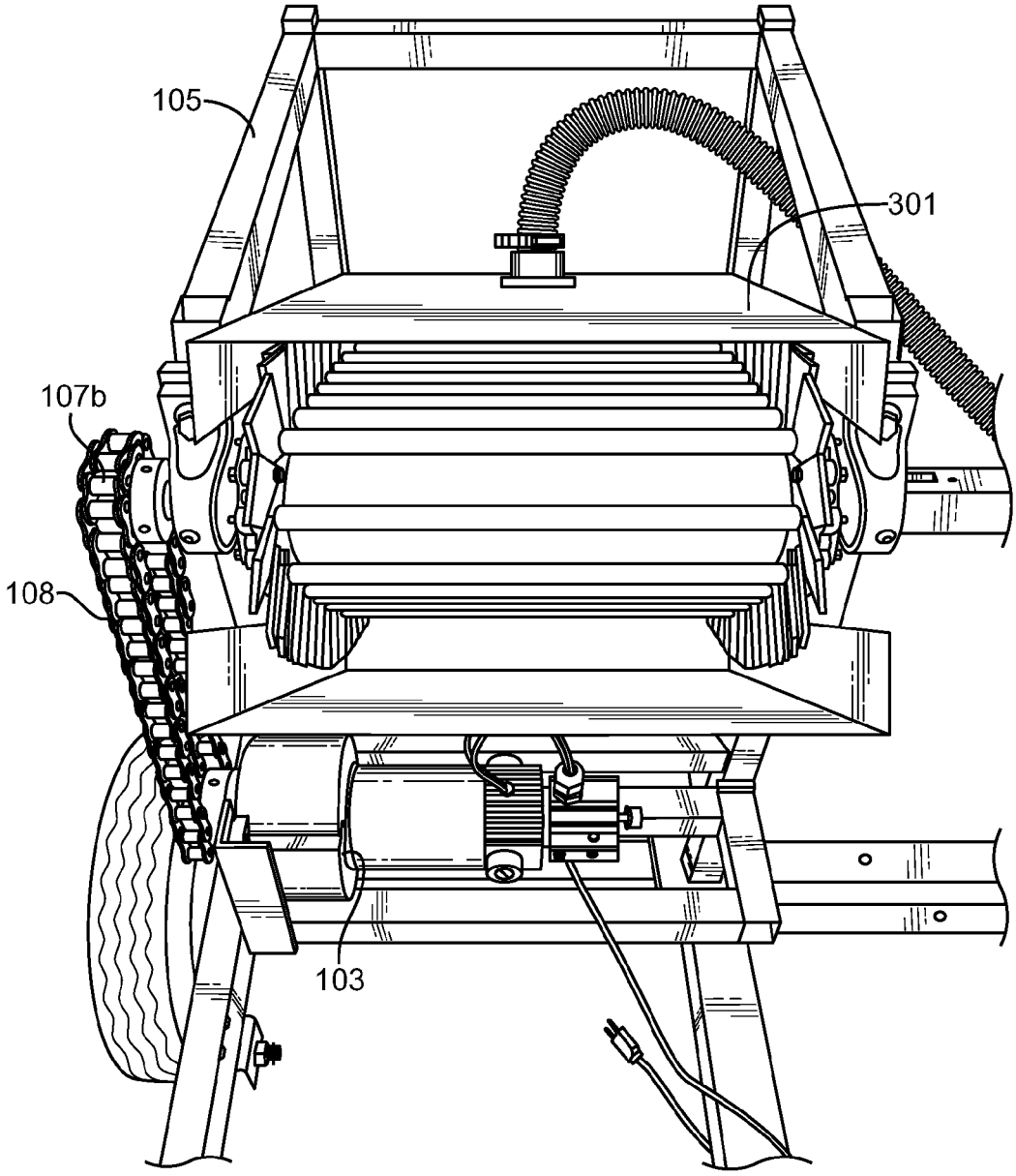
FIG. 3 shows a perspective view of an embodiment of a system according to the invention.

The operation of the disclosed systems may generate dust as air is forced, from air box 102, through a feed material that is loaded onto porous belt 101. The degree of dust generated will of course depend on whether the feed material is subjected to the particle separator 200 prior to being loaded onto the porous belt assembly, the number of passes through particle separator 200 that the feed material is subjected to, and the velocity of air that is used to pass through particle separator 200. Thus, in an aspect of the invention, at least a portion of porous belt assembly 101 can be contained within an enclosure so as to permit the enclosure to collect any dust particles that may become airborne as air or other gas is passed through a feed material that is loaded onto porous belt assembly 101. FIG. 3 depicts an embodiment of the system of the invention wherein enclosure 301 surrounds a portion of porous belt assembly 101. Enclosure 301 is open on its ends so as to permit porous belt assembly 101 to rotate around air box 102 and through enclosure 301. In another aspect of the invention, the entire system, with or without particle separator 200, may be contained within an enclosure so as to prevent the generation of dust during the operation of the system. The enclosure described herein, including enclosure 301, may be connected to a vacuum source and filter for collecting dust particles that are generated by the operation of the system.

Some aspects of the invention relate to methods of using the system for environmental remediation of a contaminated material. Accordingly, a material containing or suspected of containing at least one heavy mineral (i.e. feed material) is loaded onto porous belt assembly 101 which is arranged at an incline. Air or another gas is then forced from air box 102 through porous belt assembly 101 and the feed material. The force of air through the feed material causes the feed material to become fluidized such that particles within the fluidized feed material separate in manner that permits at least one heavy mineral within the contaminated material to migrate to the lower portion of the fluidized contaminated material where they collect against cross members 106*a-n* due to the incline of porous belt assembly 101. Meanwhile, the remainder of the feed material, less at least a portion of the heavy minerals, flows down the incline and off porous belt assembly 101 while drive motor 103 carries heavy minerals up the incline as they are captured on cross members 106*a-n*. Once cross-members 106*a-n* and the captured heavy minerals (i.e. enriched materials) reach the top of the incline, the heavy minerals are dumped onto collection chute 110 as cross-members 106*a-n* rotate under the top of porous belt assembly 101 whereupon the captured heavy minerals are collected and disposed of or used in other industrial or commercial applications. Fluidization of the contaminated material may be enhanced by activation of one or more oscillator motors that are in vibratory communication with porous belt assembly 101. In addition, fluidization of the contaminated material may be enhanced by removal of dust particles using particle separator 200 prior to loading the contaminated material onto porous belt assembly 101. In some aspects of the invention, the speed of drive motor 103 is adjustable and can range between about 0.10 to 15 RPM.

Figure 5:
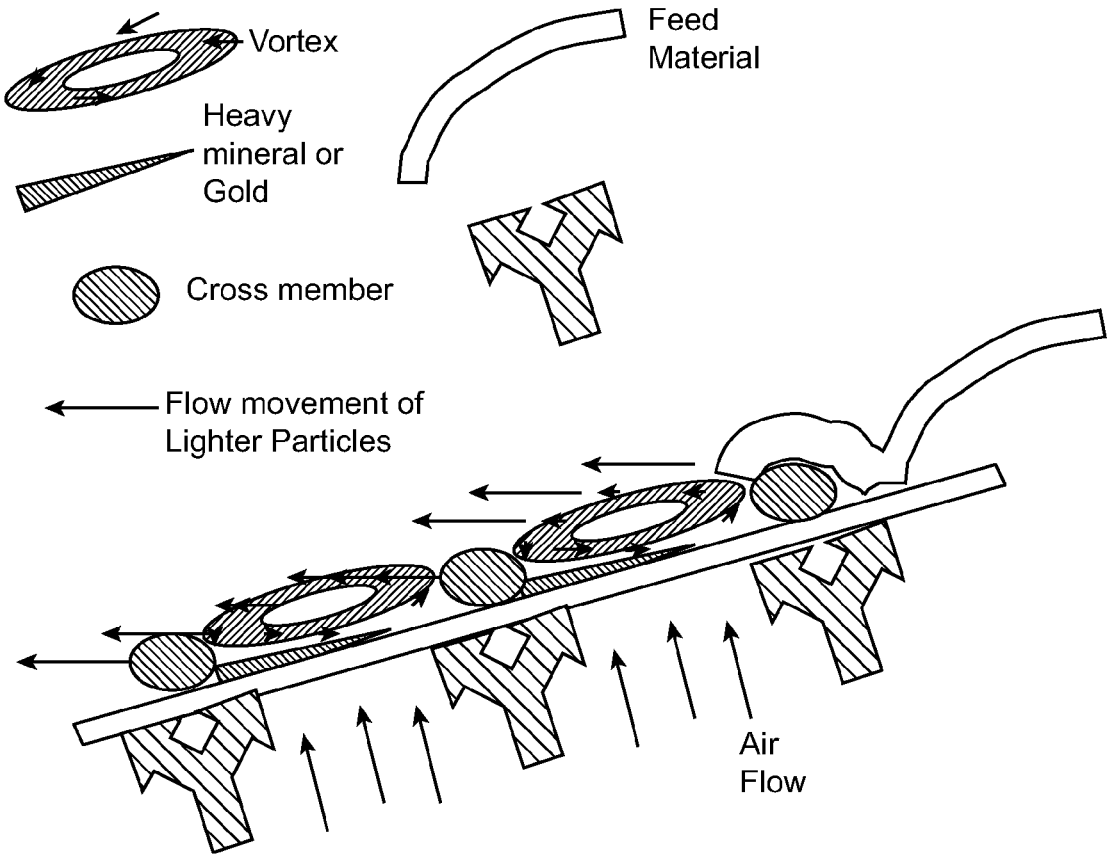
FIG. 5 shows the function of vortices in the separation of heavy minerals from a feed material.

Without being limited to any particular theory or mechanism, the systems and methods disclosed above separate heavy minerals from feed materials through the creation of one or more vortexes, or vortices. A vortex is a mass of spinning air or liquid that produces a gravitation pull towards the center of the mass. As shown in a non-limiting example in FIG. 5, vortices are formed in a feed material that is subjected to the systems described above. As a feed material is loaded onto the porous belt assembly, air or other gas is forced through the porous belt assembly and the feed material. The forced air or other gas causes the feed material to become fluidized and the interaction of the fluidized feed material and the cross members creates a series of vortices between the cross-members. The gravitation pull of the vortices pulls the heavy minerals towards the center of the vortices due to their higher density and separates them from the other, less dense species of the feed material causing the heavy minerals to collect on the porous belt assembly. As the heavy minerals collect on the porous belt assembly, the less dense species in the feed material migrate down the porous belt assembly through the action of gravity.

Figure 4:
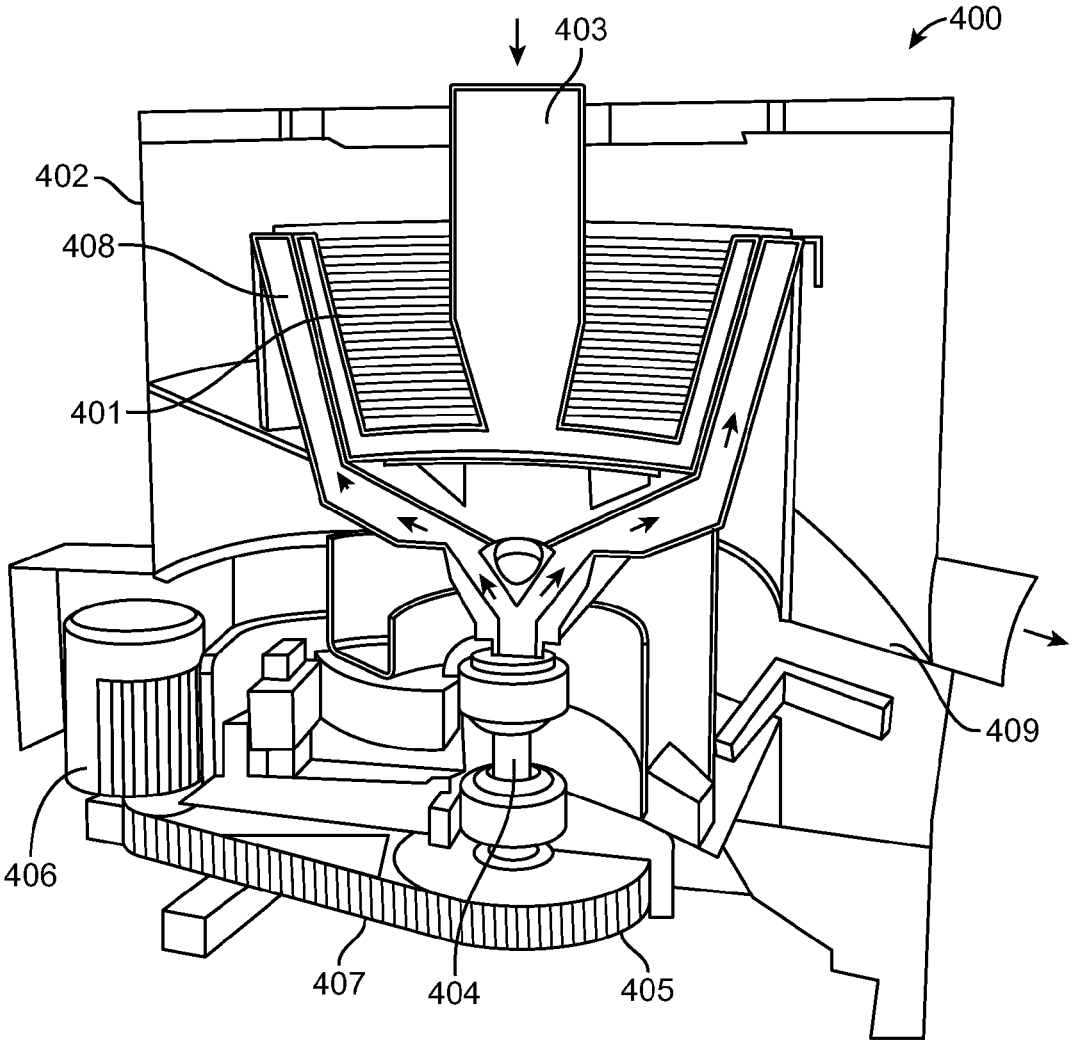
FIG. 4 shows a perspective view of an embodiment of a system according to the invention.

The collection of a contaminated material as disclosed herein may be carried out using a system such as system 400 depicted in FIG. 4. As shown in FIG. 4, such a system may comprise collection body 401 enclosed within housing 402 which is traversed at its upper end by feed inlet 403. Feed inlet 403 may contain a check-valve to prevent the efflux of feed material and loss of air pressure when air pressure is applied as described below. Collection body 401 is connected on its lower end to drive shaft 404 which is connected to belt wheel 405. Activation of drive motor 406 causes the rotation of a motor shaft in operable connection with belt 407 thereby turning belt wheel 405, drive shaft 404 and collection body 401. Collection body 401 is surrounded by collection body housing 408 in a closed manner that permits positive pressure to form around collection body 401 when air or another gas is forced into collection body housing 408. Collection body 401 and collection body housing 408 may contact one another at the upper interface of collection body 401 and collection body housing 408 in a manner that permits positive pressure to form around the outside of collection body 401. Collection body 401 can assume a configuration comprising a series of concentric rings that proceed in a step-wise fashion towards the upper end of collection body 401. Collection body 401 can be porous in construction so as to permit air or other gases to permeate from collection body housing 408 through collection body 401 when positive pressure is produced within collection body housing 408. Accordingly, collection body 401 may be manufactured using suitable porous materials as will be appreciated in the art. Collection body 401 can have a porosity of between about 4 to about 200 mesh. Collection body 401 can be manufactured, for example, from a frame over which a porous cloth is stretched. Collection body 401 may be manufactured in a manner and with the materials described for porous belt assembly 101 described herein. Collection body 401 may be manufactured from a series of independent, stacked, concentric rings that permit replacement of individual rings rather than the entire collection body. In some embodiments, collection body 401 is conical in shape. Collection body 401 may have a conical bottom or flat, planar bottom, both of which are porous. The bottom of collection body 401 may similarly be of a solid, non-porous construction. Collection body 401 may have a porosity as provided for porous belt assembly 101. Collection body 401 may have a porosity of about 2 mm to about 2,000 microns in size, including a combination of such pore sizes. Collection body 401 may comprise cloth in contact with a frame. Such cloth may have a thread count of 200 or more. Collection body 401 can comprise a solid annular ring on its upper end. The annular ring can comprise a width so as to form a flange on the upper end of collection body 401.

In practice, system 400 can operate by activating drive motor 406 to impart a spinning motion on belt wheel 405, drive shaft 404 and collection body 401 through the transfer of energy by drive belt 407. Concurrently, positive pressure is created in collection body housing 408 through the introduction of air or other gas such as from a compressor, pump, fan, blower or source of compressed air or other gas. Such air or gas may be introduced through a casing that surrounds drive shaft 404 (not shown) and terminates in fluid communication with the bottom of collection body housing 408. Alternatively, the air or other gas may be introduced through an inlet on the side of collection body housing 408, or other location that permits air or another gas to be introduced into collection body housing 408. With positive pressure formed around collection body 401 as it rotates under the force of drive motor 406, feed material is introduced to system 400 through feed inlet 403. The introduced feed material contacts the bottom of collection body 401 and is forced against the walls of collection body 401 by the centrifugal force that is imparted by the rotation of collection body 401. The centrifugal force causes the contaminated material to climb the walls and concentric, step-wise design of collection body 401 as the air or other gas under positive pressure permeates the sides and bottom of collection body 401. The concurrent centrifugal force and air flow through collection body 401 causes fluidization of the feed material such that heavy minerals are caused to collect in the recesses of the steps formed in collection body 401 as dust and less dense components of the feed material are caused to flow either out the top of collection body 401 or over the sides of the upper end of collection body 401 where they collect in housing 402. The bottom of housing 402 may be designed in a manner that is sloped, angled, or grooved towards one or more outlets 409 to permit processed feed material to exit system 400. In order to facilitate the overall flow of material through system 400, one or more oscillator motors may be put in communication with the system so as to cause vibration in one or more of collection body 401, collection body housing 408 and housing 402. Housing 402 can comprise one or more outlets (not pictured) for placing housing 402 in communication with a vacuum and filter for collecting dust particles that are liberated during the separation of heavy minerals from the feed material. Additionally, such vacuums may supplement or replace the positive pressure that is created between collection body 401 and collection body housing 408. After operation of the system in the manner described, collection of the heavy minerals is accomplished by deactivating drive motor 406 and ceasing positive pressure within the system. Collection body 401, containing heavy minerals on the wall of collection body 401 and in recesses of its step-wise concentric rings, is then removed from collection body housing 408 and housing 402. The heavy minerals may be removed from collection body 401 by, for example, inverting collection body 401 and subjecting it to one or more of shock forces (e.g. tapping, banging or pounding), vibration and/or the gentle application of forced air or other gas. In embodiments where collection body 401 is formed from a series of independent concentric rings, collection of heavy minerals may take place by collecting material from the individual rings as described above (e.g. banging or pounding, vibration and the gentle application of forced air or other gas).

As with other methods of operation disclosed herein, feed material may be subjected to the particle separator as disclosed herein so as to remove at least a portion of dust particles from the feed material prior to introducing it system 400. Additionally, system 400 may be used in conjunction with the other systems and/or methods disclosed herein. For example, system 400 may be used to process feed material before the feed material is subjected to processing using the other systems and/or methods disclosed herein. System 400 may be used to collect residual heavy minerals that might remain within a processed feed material that was processed using the other systems and/or methods disclosed herein by re-introducing the processed feed material. System 400 may be used in a series of processing steps wherein enriched feed material is re-introduced to system 400 one, two, three or more times. System 400 may be used in a series of processing steps wherein processed feed material is re-introduced to system 400 one, two, three or more times. The other systems and/or methods disclosed herein may similarly be used to process processed feed material produced by system 400. Overall, a processed feed material may be introduced to one or more of the systems and/or methods disclosed herein one, two, three, or more times.

The methods and systems disclosed herein may be used in the environmental remediation of materials that have been contaminated by any commercial or industrial practice that deposits heavy minerals (e.g. heavy metals) in the contaminated material. Accordingly, the systems and methods disclosed herein may be used to remediate mine tailings, soil, smelter waste, mine waste, placer material, ore, topsoil, coal, crushed rock, sediments, manure, and combinations thereof. In addition, the methods and systems disclosed herein may be used to remediate materials that are contaminated due to industrial activities (e.g. manufacturing, waste and refuse disposal, recycling, smelting or mining), agriculture (e.g. crop production, the use of pesticides, ponding, soil leaching, the use of fertilizers and accumulation of manure from animal husbandry), chemical spills, disposal of high metal wastes, land application of fertilizers, sewage treatment, sludge treatment, wastewater treatment, energy production (e.g. use of coal), spillage of petro-chemicals, auto-repair and maintenance activities, and atmospheric deposition.

Following the remediation of material using the systems and methods and/or systems disclosed herein, such processed material may be returned to the source from which the contaminated materials were obtained. Thus, the processed materials can be returned to their source without producing an environmental risk. Alternatively, processed materials may be used in other applications which were not possible due to the presence of one or more heavy mineral (e.g. heavy metals). For example, processed materials may be used for landfill, backfill, or other construction applications. Processed materials, such as materials comprising soils (e.g. topsoil) or sediments, may be used in agricultural applications. Processed materials comprising sediment may be returned to the body of water from which they were obtained, or other body of water.

In aspects of the invention, the systems and methods disclosed herein may be used for collecting and concentrating one or more heavy minerals. Heavy minerals concentrated and collected using the methods and/or systems disclosed herein can be used in commercial or industrial applications. Heavy minerals collected and enriched may be purified so as to produce a single species of heavy mineral and used in commercial or industrial applications.

It is understood that modifications which do not substantially affect the activity of the various embodiments of this invention are also included within the definition of the invention provided herein.

We claim:

1. A method for the environmental remediation of a material that is contaminated with heavy minerals, the method comprising:

providing a material that is contaminated with at least one heavy mineral;

subjecting the contaminated material to a vortex particle separator under conditions sufficient to remove a first portion of dust particles from the contaminated material thereby producing a dust suppressed contaminated material;

loading the dust suppressed contaminated material onto a porous belt assembly that comprises a plurality of cross members, wherein the belt assembly comprises a top layer of cotton fabric and wherein the belt assembly rotates upward with respect to an incline;

forcing a gas through the belt assembly as the belt assembly rotates upward with respect to the incline;

wherein the forcing of the gas through the belt assembly fluidizes the dust suppressed contaminated material in a manner that causes at least a first portion of the at least one heavy mineral to gather on the plurality of cross members while the remainder of the dust suppressed contaminated material flows down the incline and off of the belt assembly as the belt assembly rotates upward with respect to the incline; and collecting the gathered at least one heavy mineral.

2. The method of claim 1, further comprising collecting a second portion of dust particles from the dust suppressed contaminated material as the dust suppressed contaminated material is fluidized by the forcing of gas through the belt assembly.

3. The method of claim 1, wherein the belt assembly is contained within an enclosure that is configured to collect dust particles that become airborne as the gas is forced through the belt assembly.

4. The method of claim 3, further comprising collecting the airborne dust particles under vacuum.

5. The method of claim 1, wherein the contaminated material comprises at least one of mine tailings, soil, ore, crushed rock, and sediment.

6. The method of claim 1, wherein the at least one heavy mineral is a toxic heavy mineral.

7. The method of claim 1, wherein the at least one heavy mineral is a radioactive heavy mineral.

8. The method of claim 1, wherein the belt assembly comprises at least one oscillation device that is configured to provide vibration to the belt assembly.

9. The method of claim 1, further comprising collecting a second portion of the at least one heavy mineral from the remainder of the dust suppressed feed material.

10. The method of claim 1, wherein the remainder of the contaminated material is substantially free of the at least one heavy mineral.

11. A system for the environmental remediation of a material that is contaminated with a heavy mineral, the system comprising:

a vortex particle separator that is configured to remove dust particles from a material that is contaminated with at least one heavy mineral;

a porous belt assembly having a top layer comprised of cotton fabric wherein the porous belt assembly is configured to receive from the vortex particle separator the material that is contaminated with at least one heavy mineral;

an air box in gaseous communication with the porous belt assembly, wherein the porous belt assembly surrounds the air box and the gaseous communication forces a gas through the porous belt assembly and the contaminated material; and a motor for driving the porous belt assembly in a manner that causes the porous belt assembly to rotate about the air box at an incline with respect to a horizontal axis.

12. The system of claim 11, further comprising an enclosure that substantially encloses the porous belt assembly and the air box in a manner that prevents dust particles from escaping the enclosure when dust particles are made airborne as a result of air being forced from the air box through the porous belt assembly and the contaminated material.

13. The system of claim 12, further comprising (i) a vacuum motor for producing a vacuum within the enclosure, and (ii) a particle collection assembly in communication with the enclosure and the vacuum motor, wherein the particle collection assembly is configured to collect the airborne dust particles.

14. The system of claim 11, further comprising at least one oscillation motor connected to the porous belt assembly in a manner that permits the at least one oscillation motor to produce vibration in the porous belt assembly.

15. The method of claim 1, wherein the vortex particle separator comprises a single inlet for receiving a pressurized gas.

16. The system of claim 11, wherein the vortex particle separator comprises a single inlet for receiving a pressurized gas.

* * * * *